US007836730B1

(12) United States Patent
Pai

(10) Patent No.: US 7,836,730 B1
(45) Date of Patent: Nov. 23, 2010

(54) CIRCULAR KNITTING MACHINE JACQUARD NEEDLE EQUIPPED WITH A RETURN STRUCTURE

(75) Inventor: Tieh-Hsiung Pai, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 12/754,142

(22) Filed: Apr. 5, 2010

(51) Int. Cl.
*D04B 35/02* (2006.01)

(52) U.S. Cl. ..... 66/123; 66/221; 66/222

(58) Field of Classification Search ..... 66/123, 66/121, 221, 222
See application file for complete search history.

(56) References Cited

U.S. PATENT DOCUMENTS 2,025,462 A * 12/1935 Lombardi ..... 66/216
4,112,712 A * 9/1978 Bini ..... 66/157
4,570,463 A * 2/1986 Otto ..... 66/221
6,014,875 A * 1/2000 Lonati et al. ..... 66/220
6,178,786 B1 * 1/2001 Willmer ..... 66/221
6,705,130 B2 * 3/2004 Weihing et al. ..... 66/123
7,739,889 B2 * 6/2010 Lonati et al. ..... 66/220

FOREIGN PATENT DOCUMENTS

TW 435457 5/2001

* cited by examiner

*Primary Examiner*—Danny Worrell
(74) *Attorney, Agent, or Firm*—Muncy, Geissler, Olds & Lowe, PLLC

(57) ABSTRACT

A jacquard needle equipped with a return structure is installed in a circular knitting machine which has a computer needle selected device including plural jacquard needles and plural needle selected sheets on an upper needle dial. Each jacquard needle is driven by a cam to move a knitting needle. The needle selected sheet depresses the jacquard needle to escape from the cam. The jacquard needle includes a fulcrum, a neck, a force received section, a needle foot and a return structure. The fulcrum is connected with the knitting needle. The needle foot is located in a slide track of the cam. The return structure has a bend end at a distal end beneath the needle foot. The bend end butts an inner wall of the upper needle dial. The force received section transmits the depressing force to bend the return structure to generate a returning elasticity.

5 Claims, 5 Drawing Sheets

CIRCULAR KNITTING MACHINE JACQUARD NEEDLE EQUIPPED WITH A RETURN STRUCTURE

FIELD OF THE INVENTION

The present invention relates to a circular knitting machine jacquard needle equipped with a return structure and more particularly to a jacquard needle that is driven by a needle selected device in a circular knitting machine to drive a knitting needle in and out.

BACKGROUND OF THE INVENTION

A conventional circular knitting machine generally has a needle selected device to form jacquard patterns on the surface of knitting fabrics. Through the needle selected device, a knitting needle can be driven out or in to form a knitted area or an un-knitted area on the fabric. More specifically, the needle selected device includes a plurality of needle selected sheets. Each knitting needle is connected with a jacquard needle. The jacquard needle has a fulcrum latched on the knitting needle and a needle selected section extended from the fulcrum. The needle selected section has a rear end formed a needle foot movable in a track formed by at least one cam. The needle selected section includes a plurality of needle butts. When the needle selected device is moved away from the needle selected sheets, the needle foot can drive the knitting needles outwards to hook and pull a yarn to form a yarn loop according to the track formed by the cam. While the needle selected device drives any one of the needle selected sheets to push the needle butts, the jacquard needle is pushed to escape from the cam, so that the knitting needle cannot be moved out to do knitting. Hence whether a knitting pattern is formed depends on whether the jacquard needle is being pushed by the needle selected device to escape from the cam. The jacquard needle is not driven by the cam, so that the knitting needle cannot be pushed out to do knitting.

To improve return mechanism of the jacquard needle, Applicant submitted a patent application in 1997 at R.O.C. patent No. 435457 entitled: "Circular knitting machine computer jacquard needle selected sheet automatic return apparatus". The highlight is depicted in its abstract as follow: "A circular knitting machine computer jacquard needle selected sheet automatic return apparatus allows a needle selected sheet to automatically return to the path of a needle-pushing cam after being pushed downwards by a needle selected foot. The needle selected sheet has a return apparatus at a back side on a desired location. The return apparatus has an arched portion at one end butting an inner wall of an upper needle dial. After the needle selected sheet is pushed downwards by the needle selected foot of the needle selected device, the needle foot of the needle selected sheet escapes from the path of the needle-pushing cam. Meanwhile, the gap formed between the back side of the needle selected sheet and the return apparatus shrinks, and the needle selected sheet does not push the sinker outwards. Hence the yarn hooked and pulled by the knitting needle cannot form a yarn loop. After the needle foot of the needle selected sheet has slid over by the surface of the cam portion of the needle-pushing cam, the elasticity of the return apparatus pushes the needle foot back to the path of the needle-pushing cam". As mentioned in the aforesaid abstract, the needle selected sheet is driven by the needle-pushing cam in normal conditions so that the knitting needle at the front end of the needle selected sheet hooks and pulls a yarn to form a yarn loop, or at least one needle selected sheet is pushed by the needle selected device to escape from the needle-pushing cam, so that the knitting needle cannot be driven by the needle selected sheet to form the yarn loop. More specifically, the needle selected sheet has the return apparatus that is an elastic plate, an elastic rod or an elastic strut butting the upper needle dial to provide an automatic returning force for the needle butts of the needle selected sheet.

However, R.O.C. patent No. 435457 mentioned above has some drawbacks in practice. First, the return apparatus is located on the needle foot of the jacquard needle, this limits the length of the return apparatus, and it also creates a longer movement distance when the jacquard needle is moved downwards. The longer movement distance of the return apparatus results in a greater stress it has to withstand. Since the interior space of a circular knitting machine is limited, the thickness of the return apparatus is difficult to increase, thus the lifespan of the return apparatus also is shorter. Moreover, the longer movement distance of the return apparatus also results in greater elastic force pushing the needle foot of the jacquard needle to return, and impact of the needle foot on the cam also is greater, this easily damages the jacquard needle after using for a long-term period of time.

Damage of the jacquard needle creates obvious defects on the knitted fabrics. As the circular knitting machine is quite bulky and consists of a great number of elements, it is difficult to inspect and identify the damaged elements, hence there is still room for improvement in terms of overcoming the wearing and loss problems caused by the return apparatus.

SUMMARY OF THE INVENTION

In view of the problems of the conventional return apparatus that cause severe wearing on the jacquard needles and shorten the life span thereof, the primary object of the present invention is to provide a return structure to push the jacquard needles back without causing heavy wearing and shortening the lifespan thereof.

The present invention provides a circular knitting machine jacquard needle equipped with a return structure adopted for use on a circular knitting machine. The circular knitting machine includes a plurality of knitting needles which are controlled by a plurality of cams and a plurality of computer needle selected devices. The computer needle selected device includes a plurality of needle selected sheets and a plurality of jacquard needles located on an upper needle dial. The jacquard needles are driven by the cams in normal conditions to drive the knitting needles. The needle selected sheets press the jacquard needles downwards to escape from the cams. Each jacquard needle includes a fulcrum, a neck extended from the fulcrum, a force received section connected to the neck, a needle foot extended from the force received section and a return structure extended from the neck. The jacquard needle is connected with the knitting needle through the fulcrum so that movement of the jacquard needle drives the knitting needle. The force received section has a plurality of needle butts pressed by the needle selected sheets and the needle foot is extended from the force received section. The needle foot is located in a slide track formed on the cam in normal conditions. The return structure has a distal end with a bend end formed thereon beneath the needle foot. The bend end butts an inner wall of the upper needle dial. The return structure and the force received section are interposed by a retraction gap to provide a movement space for the force received section while depressed by the needle selected sheet. The neck transmits the depressed force to bend the return structure and generate an elastic force to rebound the force received section to return back.

By means of the structural change of the jacquard needle and alteration of connecting position of the return structure, the stress born by the jacquard needle is reduced obviously, and the returning elasticity does not directly apply to the force received section, thus impact of the force received section against the cams during rebounding also is alleviated. As a result, the return function is achieved and the lifespan of the jacquard needles also is longer.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
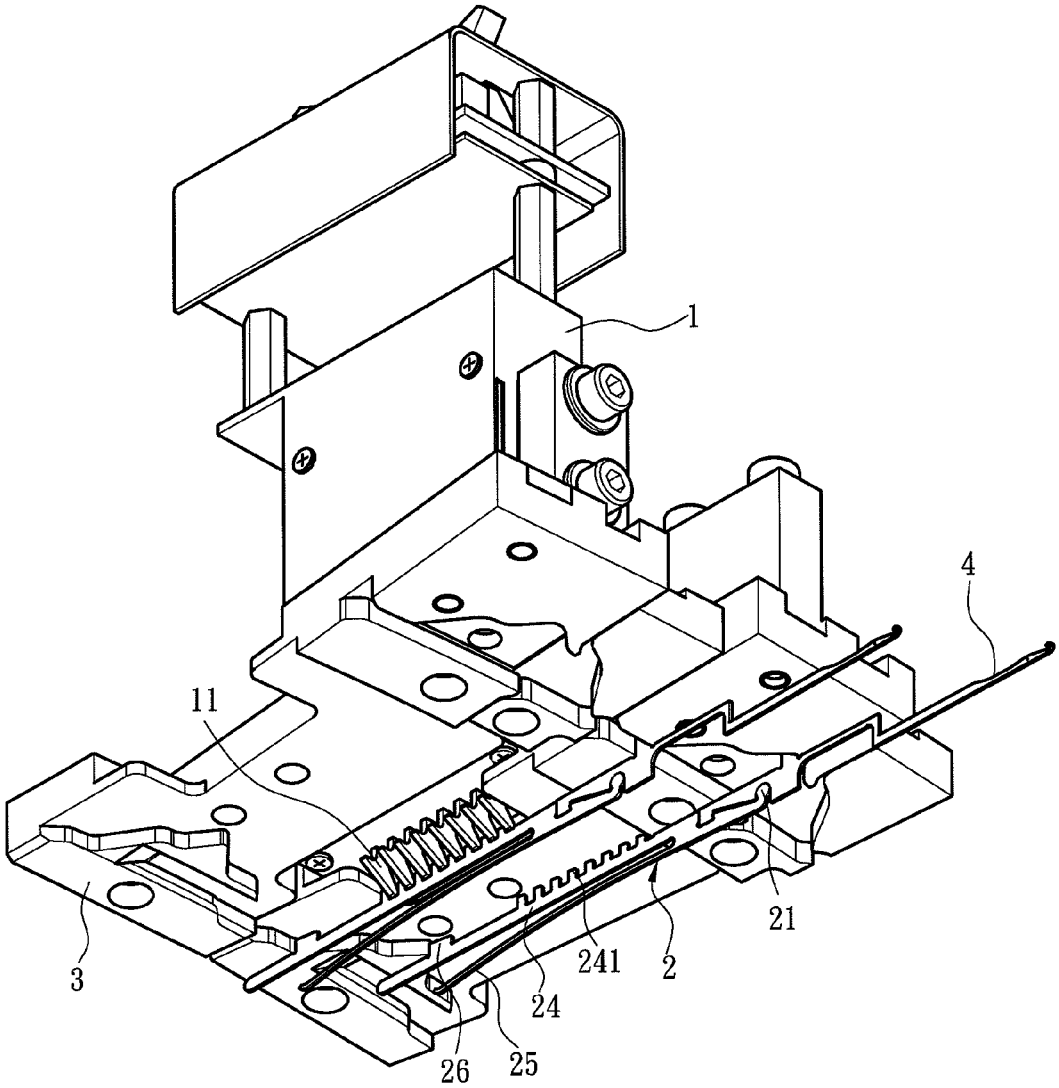
FIG. 1 is a perspective view of the computer needle selected device and knitting needles.
Figure 2:
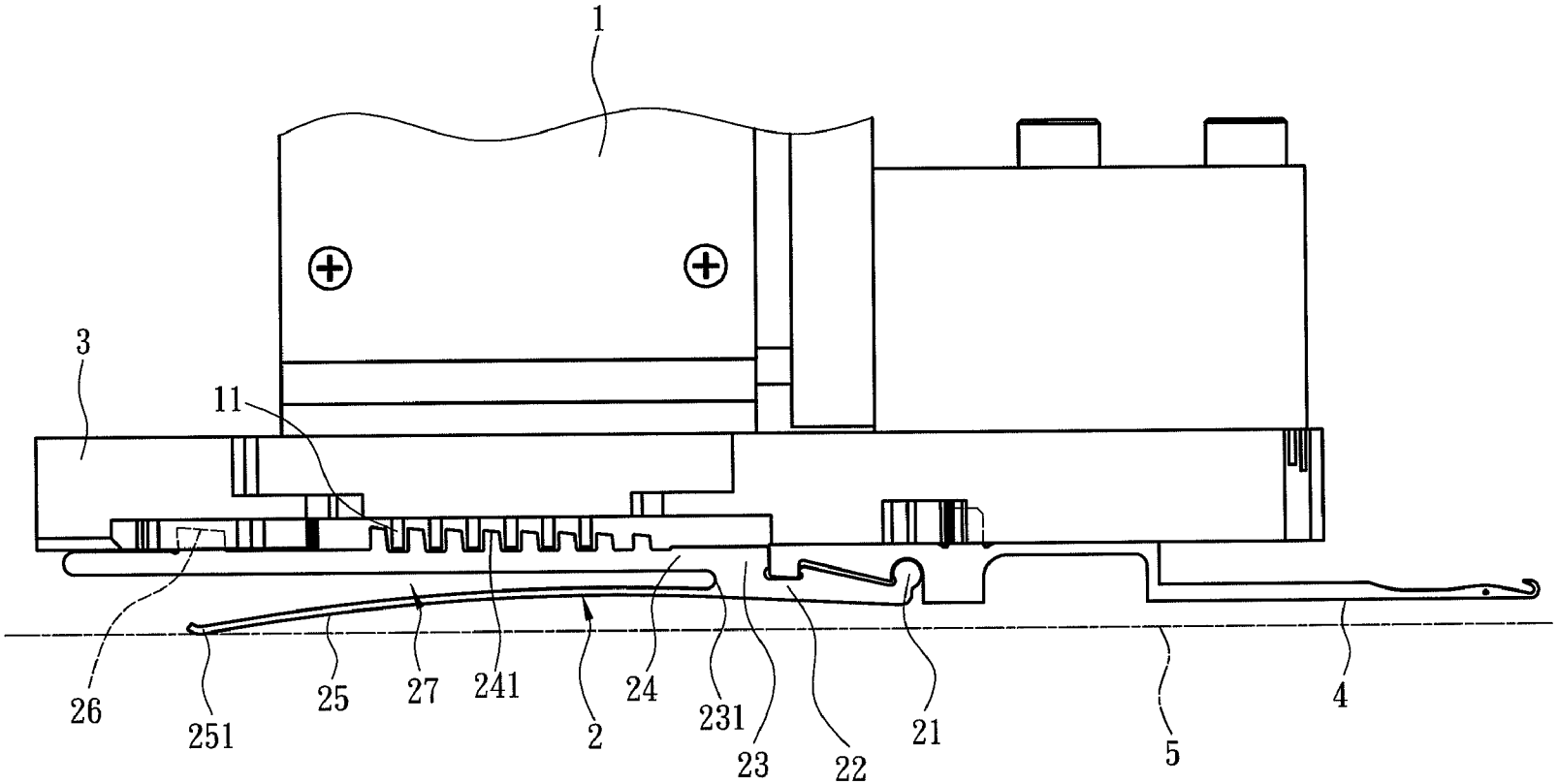
FIG. 2 is a schematic view of a jacquard needle and a knitting needle in a first condition.
Figure 3:
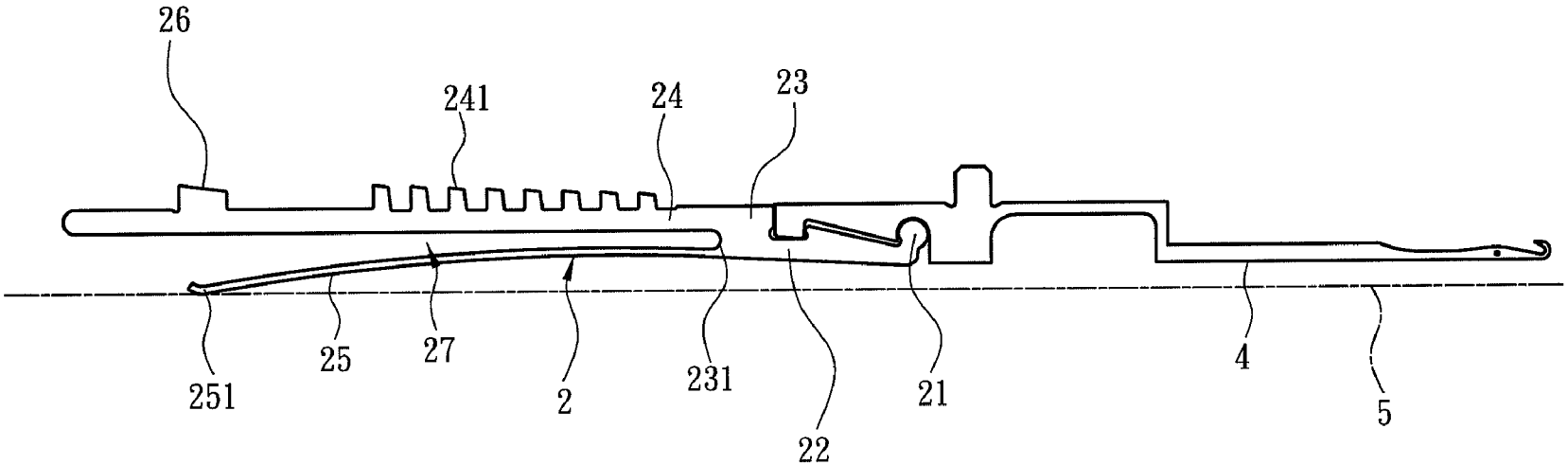
FIG. 3 is another schematic view of a jacquard needle and a knitting needle in the first condition.
Figure 4:
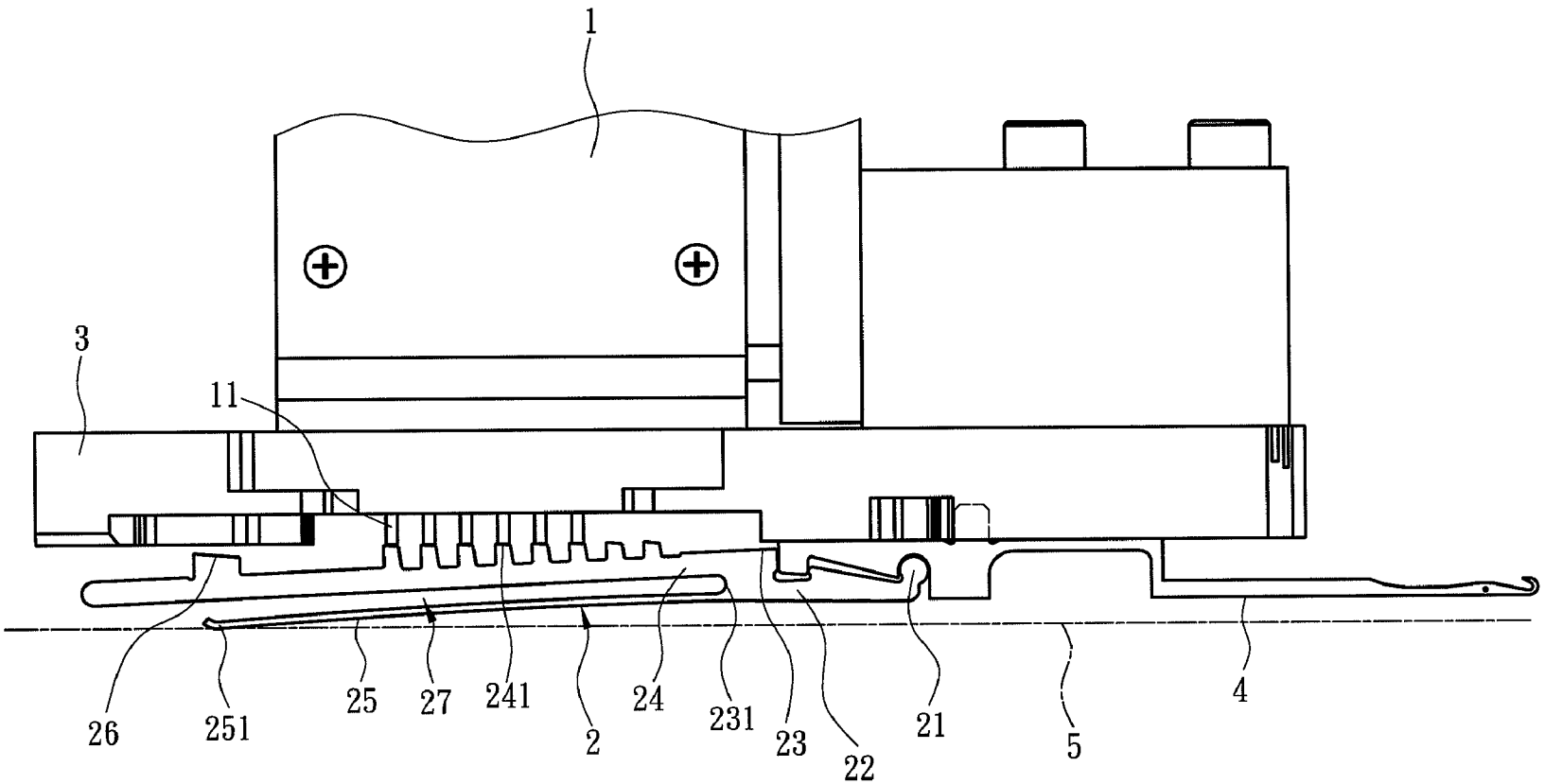
FIG. 4 is a schematic view of a jacquard needle and a knitting needle in a second condition.
Figure 5:
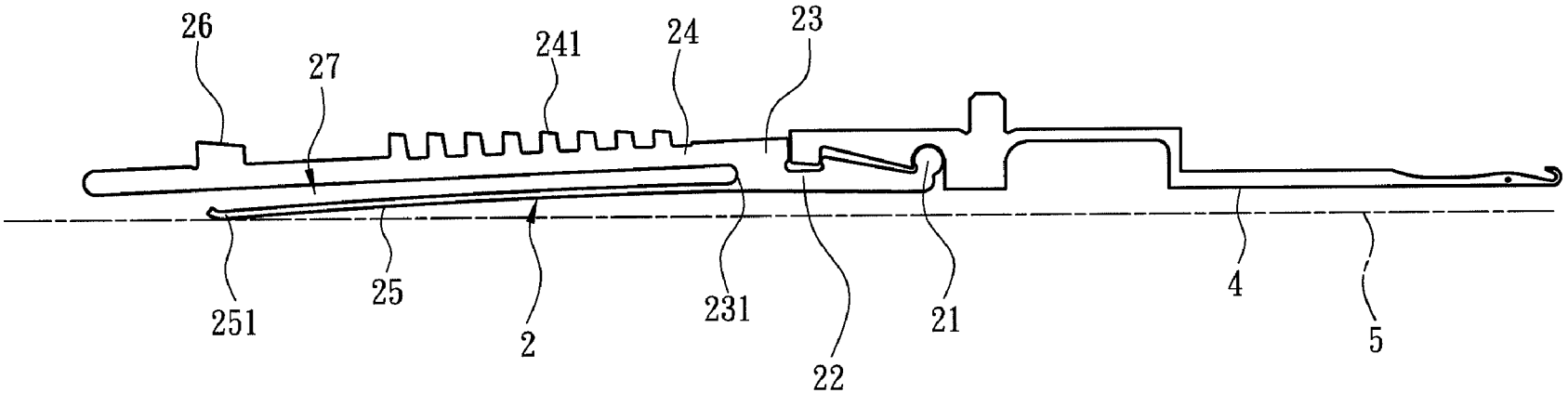
FIG. 5 is another schematic view of a jacquard needle and a knitting needle in the second condition.

Please refer to FIGS. 1, 2 and 3 for a circular knitting machine jacquard needle equipped with a return structure according to the invention. The circular knitting machine includes a plurality of computer needle selected device and a plurality of cams 3 to drive a plurality of knitting needles 4 in and out to knit yarn loops on a fabric as desired. Operation of the knitting needles 4 is controlled by the computer needle selected device and cams 3. The computer needle selected device includes a plurality of needle selected sheets 11 located on a needle selected device body 1 and a plurality of jacquard needles 2 located on an upper needle dial 5. Each jacquard needle 2 has one end connected with one knitting needle 4 to be moved together and the other end is driven by the cam 3 in normal conditions (a first condition) to drive the knitting needle 4 to move. The needle selected sheet 11 on the needle selected device body 1 depresses downwards to press the jacquard needle 2 (referring to FIG. 4) and push the jacquard needle 2 to escape from the cam 3 to free the control thereof (a second condition), therefore the jacquard needle 2 and knitting needle 4 stop operating. To enable the jacquard needle 2 to automatically rebound back and return to a track formed on the cam 3 after being depressed by the needle selected sheet 11, the jacquard needle 2 has a return structure 25 to provide returning elasticity. Please refer to FIGS. 1, 2 and 3 for the detailed structure of the jacquard needle 2. As shown in FIGS. 2 and 3, the jacquard needle 2 includes a fulcrum 21, a neck 22, a force received section 24 connected to the neck 22, a needle foot 26 extended from the force received section 24 and the return structure 25. The fulcrum 21 is connected with the knitting needle 4. The neck 22 is extended from the fulcrum 21. The neck 22 is extended upwards to form a shoulder 23 perpendicular to the upper needle dial 5. The neck 22 is connected to the force received section 24 through the shoulder 23. The force received section 24 is located at a higher horizontal elevation than the neck 22 in the circular knitting machine through the shoulder 23. The force received section 24 has a plurality of needle butts 241 depressed by the needle selected sheets 11. The force received section 24 also is extended to form the needle foot 26 which is located in a slide track formed on the cam 3 in the normal conditions. The return structure 25 is extended from the neck 22 and has a distal end formed a bend end 251 beneath the needle foot 26. The return structure 25 is formed at an arch from the neck 22 to the bend end 251. The bend end 251 butts an inner wall of the upper needle dial 5. Moreover, the return structure 25 and the force received section 24 are interposed by a retraction gap 27 to provide a movement space for the force received section 24 while depressed by the needle selected sheet 11. The shoulder 23 has an arched notch 231 at one end of the retraction gap 27. Referring to FIGS. 4 and 5, the needle selected device body 1 drives the needle selected sheet 11 downwards to press the needle butts 241 on the force received section 24, the force received section 24 sinks to the retraction gap 27 to make the needle foot 26 to escape from the track formed on the cam 3 so that the jacquard needle 2 and knitting needle 4 stop moving in and out. Sinking of the force received section 24 transmits the depressing force through the neck 22 to bend the return structure 25 to generate an elastic force. When the force received section 24 of the jacquard needle 2 is no longer depressed by the needle selected sheet 11, the elastic force generated by the return structure 25 rebounds the force received section 24 back so that the needle foot 26 returns to the normal location driven by the cam 3, and the jacquard needle 2 and knitting needle 4 can be driven by the cam 3 to move in and out continuously.

Compared with the conventional return structure, the invention provides many different features: first, the return structure 25 of the invention is not directly connected to the force received section 24 but connected to the neck 22, and the force received section 24 is connected to the neck 22 through the shoulder 23, hence the force received section 24 and the return structure 25 are connected to the neck 22 like a bifurcated fork so that the downward pressure of the force received section 24 and the elasticity of the return structure 25 can be buffered through the neck 22 without directly applying to the return structure 25 or force received section 24. The return structure 25 is connected to the neck 22 and the bend end 251 is extended beneath the needle foot 26, hence the length of the return structure 25 is obviously increased in an arched manner. As a result, stress occurred to the return structure 25 resulted from depressing or releasing the elasticity is much lower, and the lifespan also is longer. The aforesaid feature can alleviate the pressure and elasticity to prevent the needle foot 26 from hitting the cam 3 during returning and avoid damage. Moreover, with the arched notch 231 formed on the shoulder 23 towards the retraction gap 27, the inner edge of the arched notch 231 can disperse the received force during sinking of the force received section 24 to mitigate metal fatigue of the shoulder 23 or neck 22 after used for a long-term period of time. In short, the jacquard needle 2 of the invention provides the force received section 24, return structure 25, neck 22 and shoulder 23 to obviously reduce stress after long time of use. Not only the needle foot 26 is equipped with return function, wearing of the return structure 25 can be avoided to enhance the lifespan of the jacquard needle 2.

The return structure 25 previously discussed can be an elastic plate, an elastic rod or an elastic strut. While the invention has been described by means of specific embodiments, numerous modifications and variations could be made thereto by those skilled in the art without departing from the scope and spirit of the invention set forth in the claims.

In summation of the above description, the present invention provides a significant improvement over the conventional techniques and complies with the patent application requirements, and is submitted for review and granting of the commensurate patent rights.

What is claimed is:

1. A circular knitting machine jacquard needle equipped with a return structure installed in a circular knitting machine which includes a plurality of knitting needles controlled by a plurality of cams and a plurality of computer needle selected device which includes a plurality of needle selected sheets and a plurality of jacquard needles located on an upper needle dial; the jacquard needles are driven by the cams in normal conditions to move the knitting needles, the needle selected sheets being movable downwards to depress the jacquard needles to escape from the cams, each of the jacquard needles comprising:

a fulcrum connected with the knitting needle;

a neck extended from the fulcrum;

a force received section which is connected to the neck and includes a plurality of needle butts depressed by the needle selected sheets;

a needle foot which is extended from the force received section and located in a slide track formed on the cam in normal conditions; and a return structure which is extended from the neck and includes a bend end at a distal end beneath the needle foot to butt an inner wall of the upper needle dial, and spaced from the force received section by a retraction gap to form a movement space while the force received section is depressed by the needle selected sheet, the return structure being bendable upon receiving a depressing force through the neck to generate an elastic force to rebound the force received section back.

2. The circular knitting machine jacquard needle equipped with a return structure of claim 1, wherein the return structure is formed in an arched manner and extended from the neck to the bend end.

3. The circular knitting machine jacquard needle equipped with a return structure of claim 1, wherein the neck is connected to the force received section through a shoulder which is extended upwards from the neck such that the force received section is at a higher horizontal elevation than the neck in the circular knitting machine.

4. The circular knitting machine jacquard needle equipped with a return structure of claim 3, wherein the shoulder includes an arched notch at one end of the retraction gap to reduce stress.

5. The circular knitting machine jacquard needle equipped with a return structure of claim 1, wherein the return structure is selectively an elastic plate, an elastic rod or an elastic strut.

* * * * *